United States Patent [19]

Luyckx

[11] 4,052,202

[45] Oct. 4, 1977

[54] ZIRCONIUM ALLOY ADDITIVE AND METHOD FOR MAKING ZIRCONIUM ADDITIONS TO STEELS

[75] Inventor: Leon Luyckx, New Castle, Pa.

[73] Assignee: Reactive Metals & Alloys Corporation, West Pittsburg, Pa.

[21] Appl. No.: 616,647

[22] Filed: Sept. 25, 1975

[51] Int. Cl.[2] ..... C22C 1/02; C22C 16/00

[52] U.S. Cl. ..... 75/129; 75/53; 75/177

[58] Field of Search ..... 75/53, 129, 177

[56] References Cited

U.S. PATENT DOCUMENTS

| | | | |
|---|---|---|---|
| 2,840,872 | 7/1958 | Bidner | 75/129 |
| 2,988,444 | 6/1961 | Hurum | 75/53 |
| 2,999,749 | 9/1961 | Saunders | 75/129 |
| 3,000,731 | 9/1961 | Ototani | 75/129 |
| 3,079,250 | 2/1963 | Bolkcom | 75/53 |
| 3,104,972 | 9/1963 | Droegkamp | 75/177 |
| 3,322,530 | 5/1967 | Nakamura | 75/53 |

*Primary Examiner*—Peter D. Rosenberg

*Attorney, Agent, or Firm*—Buell, Blenko & Ziesenheim

[57] ABSTRACT

An additive and method of making zirconium additions to steel is provided in which an alloy of about 70% to 90% zirconium and the balance iron with residual impurities is formed into uniform sized pieces and added to a bath of molten steel with various possible techniques.

11 Claims, 2 Drawing Figures

ZIRCONIUM ALLOY ADDITIVE AND METHOD FOR MAKING ZIRCONIUM ADDITIONS TO STEELS

Figure 1:
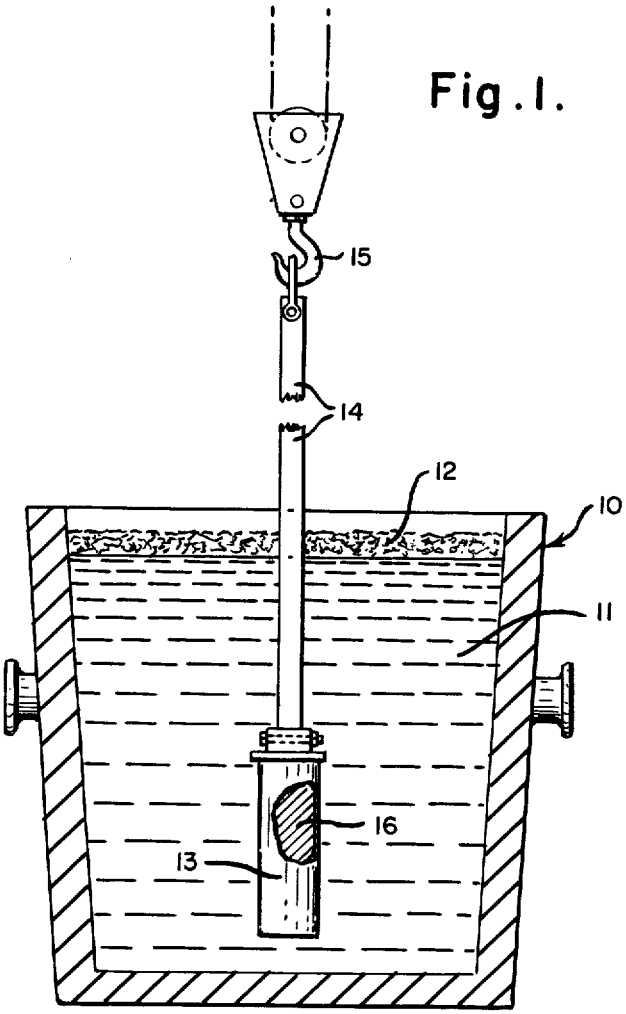

This invention relates to zirconium alloy additives and methods for making zirconium additions to steel and particularly to a zirconium-iron alloy metallurgical additive material.

Zirconium has been used as a steel making additive for over 20 years. Its prime function is to "globularize" the sulfide inclusions and hence to improve transverse impact and ductility properties which traditionally were obtainable only by lowering the sulfur content of the steel or by cross rolling plate steel or a combination of both.

Zirconium sulfide is significantly more stable than manganese sulfide in steel. Therefore, if enough free zirconium is available during the early stages of solidification of a steel ingot, ZrS will form and prevent the formation of MnS. ZrS is much more refractory than MnS and practically non-deformable during hot rolling while, in aluminum killed steels, MnS produces long flat stringer inclusions in hot rolled plate and strip.

It is the latter difference which produces the dramatic improvement in engineering properties of the steel when adding sufficient quantities of zirconium.

These are well recorded metallurgical properties and several patents have issued covering steel grades including zirconium as part of their specifications which support these statements.

Other additives introduced more recently compete with zirconium for the same sulfide globularization function, such as the rare earth (RE) metals (mischmetal), calcium, and titanium. The major advantage of the RE and calcium over Zr and Ti is that they do not precipitate nitrides, carbides, or carbo-sulfides at steelmaking temperatures.

In the practice this latter property prohibits the use of Zr or Ti in ferrous alloys of which carbon is over 0.30% and also in certain high strength low alloys steels (HSLA) of which design is at least partially based on thermomechanical precipitation of nitrides during hot rolling.

However Zirconium presents the advantage over Re and Ca in that it does not require extra low sulfur contents — say 0.015% max. — to be applicable.

The quantity of zirconium addition per ton of steel required to improve steel properties has not been found to depend on the sulfur content as it is with RE metals additions. Consequently, it is more economical to use Zr than RE in steels with sulfur contents of 0.020% or more.

In practice the amounts of mischmetal required in mold additions to obtain full benefit of the addition are as follows:

| Sulfur % (Ladle content) | Mold addition of REM |
|---|---|
| .010% max | 0.75 lb/ton |
| .010-.012 | 1.00 lb/ton |
| .012-.015 | 1.50 lb/ton |
| .015-.020 | 2.00 lb/ton |
| .020-.025 | 2.50 lb/ton |
| .025-.030 | 3.00 lb/ton |

The amounts of zirconium to be added on the other hand, depends more on the nitrogen content than on the sulfur content. To be effective, the addition of zirconium has to be sufficient to leave some free Zr after the precipitation of practically all the nitrogen content as ZrN and Zr (N,C). A following table gives an indication of the zirconium requirement as additives in aluminum killed steels.

| | Nitrogen Content % | Min. Requirements of Zr | |
|---|---|---|---|
| | | % Zr | Mold add of Zr lbs/ton |
| Traditional Bessemer Steel | .009-.015 | .10-.12 | 3 -4 |
| BOF and OH steels | .003-.006 | .06 | 1.5 -2 |
| Electric furnace steel | .005-.009 | .08 | 2.5-3 |

The combination of these two tables suggests that for basic oxygen and open hearth steels with sulfurs in the 0.020-0.030 range, 1.5 to 2 lbs. of Zr is sufficient while 2.5 to 3 lbs. of RE per ton of steel are required, which may entail an economy of several dollars per ton in using zirconium.

Historically, the first zirconium additive manufactured for steelmaking and still widely used is a ferro-silico-zirconium produced by direct reduction of zircon sands in electric arc furnaces at high temperature. This alloy is still today the lowest cost source of Zr available as steel additive. However it carries almost 50% of silicon which makes it improper for mold additions and forces to use it as a ladle addition. With this practice zirconium recoveries are of the order of 35% to 40% at best.

As a consequence, steel mill metallurgists have recently favored the use of scrap of zircaloy, a well known alloy used in the nuclear industry, as mold additives with recoveries of about 60 to 70% despite the higher unit price of this additive. However zircaloy scrap presents the disadvantage of containing occasional contaminants such as titanium, columbium and chromium and other impurities which can seriously impair steel product properties. In addition some zircaloy scrap can be very buoyant because of its shape (turnings, pipe clippings, tube ends, etc.).

I have discovered a new zirconium alloy additive and method for using the same which permits high recoveries of effective zirconium and eliminates the problems of using ferro-silicon zirconium and zircaloy scrap. The material of my invention has a much lower melting point than prior art materials which permit much faster dissolution and diffusion of the additive in steel ingots as compared with zirconium alloy scrap. Moreover, its density is such that it does not tend to float as does Zirconium alloy. The new metallurgical of my invention is preferably made up of about 83% zirconium, and the balance iron (about 15%) and residual impurities (about 2%). The alloy may, however, vary somewhat from this preferred composition within the range about 70% to about 90% zirconium, balance iron and impurities but preferably is held in the range 80% to about 85% zirconium with the balance iron and residual impurities. The preferred zirconium alloy composition has a melting point of about 934° C. as compared with 1860° C. for pure zirconium, which provides for much faster dissolution and dispersion. The alloy of my invention is preferably formed into uniform sized shapes such as balls, pyramids, bars or the like. The high density of the additive of my invention (about 6.9 gram/cc.) provides a marked advantage over zirconium alloy scrap which has irregular shapes and is generally very buoyant in a liquid steel bath with the result that a very large percentage of scrap is lost from the steel whereas a much higher rate of recovery is achieved by my invention.

Preferably the composition of my invention is formed in balls or pyramids of approximately 4 to 16 oz. in weight for ingot mold additions or alloy feeder equipment or cast in a cylindrical steel canister for ladle plunging to provide a charge weight of about 400 lbs. to 1,500 lbs. depending upon the particular mill practice involved. The canister is submerged on the end of a rod into the molten steel in a ladle and held there until the canister and contents are dissolved. However, the additive alloy may be added in a variety of other ways designed to get it into the body of molten steel. For example, it may be added as balls through the alloy feeder of the conventional degassing equipment into the steel ladle after degassing is completed. It may be added as uniform or random shaped pieces to the molten steel during teeming into ingot molds. To facilitate this mold addition, the loose alloy pieces can be bagged to a fixed weight content. It may be added in the form of annuli (donut-shaped pieces weighing 5 to 25 pounds) on the end of a plunging rod inserted in molten steel in a ladle.

Figure 2:
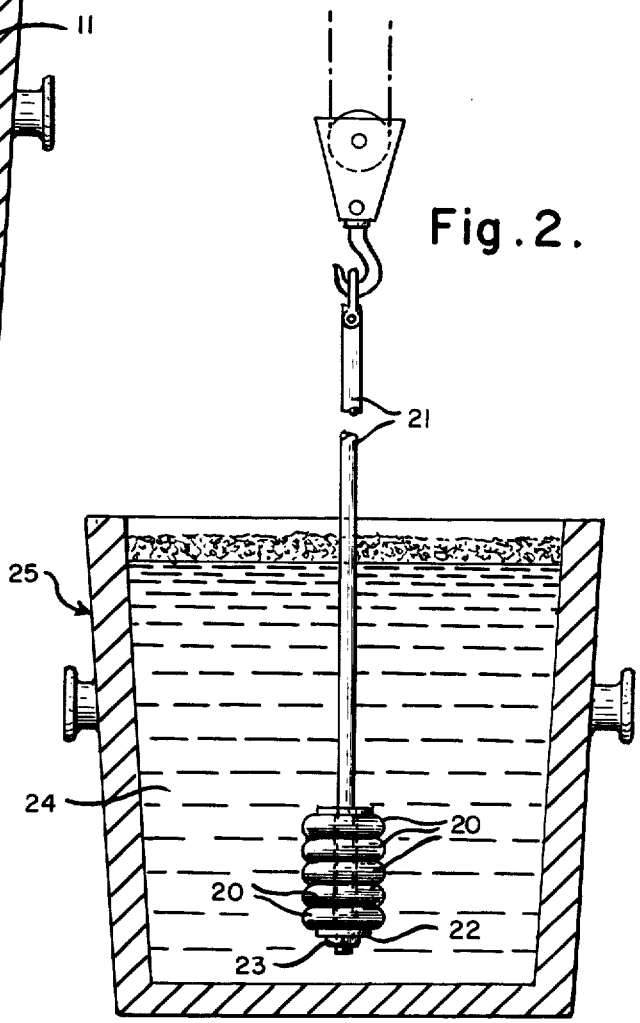

In the foregoing general description of my invention I have set out certain objects, purposes and advantages of my invention. Other objects, purposes and advantages will be apparent from a consideration of the following description and examples and from the accompanying drawings in which:

FIG. 1 is a side elevational view, partly in section, of a steel ladle illustrating a preferred practice of my invention; and FIG. 2 is a side elevational view, partly in section, of a steel ladle illustrating a second embodiment of practice according to my invention.

Referring to the drawings, I have illustrated a conventional ladle 10 containing a molten steel bath 11 covered with molten slag 12. A canister 13 in the form of a steel cylinder is submerged into the molten steel 11 on the end of an elongated steel bloom 14 suspended from an overhead crane hook 15. The canister 13 is filled with a solid casting 16 of an alloy consisting of 83% zirconium, 14.8% iron, 1.4% tin, 0.2% columbium and 0.6% other residual impurities. The alloy has a melting point of about 1,000° C. and a specific gravity of 6.9 grams/cc. as compared with the specific gravity of the molten steel at 7.2 grams/cc.

In FIG. 2 I have illustrated a plurality of 10 lbs. annuli (donuts) 20 on the end of a rod 21 held in place by washer 22 and nut 23. The annuli 20 are submerged into the body of molten steel 24 in ladle 25 and held until dissolved.

In another example balls of the alloy of my invention in 4 oz. size were introduced through the alloy feeder of the DH degassing equipment into the steel ladle after the degassing cycle of a 110 ton heat had been completed. The zirconium recovery was 58%. A like heat treated with ferro-silicon-zirconium showed a zirconium recovery of only 35%.

In another example several ingots were treated by adding 4 oz. balls of the alloy composition of this invention to the ingot molds during teeming of the ingots. Zirconium analysis on the rolled plates (front and back plates) from these ingots showed zirconium recovery in the range 80% to 90% coupled with a more than usual homogeneous distribution of the zirconium throughout each ingot.

While I have set out certain preferred embodiments and practices of my invention in the foregoing specification it will be understood that this invention may be otherwise embodied within the scope of the following claims.

I claim:

1. An additive for making zirconium additions to steel comprising generally uniformly sized pieces of an alloy consisting essentially of about 70% to 90% zirconium and the balance iron with residual impurities.

2. An additive as claimed in claim 1 wherein the zirconium content is in the range 80% to 85%.

3. An additive as claimed in claim 1 having 83% zirconium.

4. A method for adding zirconium to steel comprising the steps of:

a. forming an alloy consisting essentially of about 70% to 90% zirconium and the balance iron with residual impurities into substantially uniform sized pieces, and b. adding said uniform sized pieces to a molten bath of steel to be treated.

5. A method as claimed in claim 4 wherein the alloy is cast directly into a canister and said canister is submerged beneath the surface of the molten bath.

6. A method as claimed in claim 4 wherein the alloy is shaped into annuli and placed on the end of a rod and thereafter submerged beneath the surface of the metal to be treated.

7. A method as claimed in claim 4 wherein the zirconium in the alloy is in the range 80% to 85%.

8. A method as claimed in claim 4 wherein the zirconium is about 83% of the alloy.

9. A method as claimed in claim 4 wherein the alloy pieces are bagged and the bags added to a molten bath.

10. A method as claimed in claim 4 wherein the alloy pieces are added to a ladle through an alloy feeder.

11. A method as claimed in claim 4 wherein the alloy pieces are added to a mold containing molten steel.

* * * * *